US006745516B2

(12) United States Patent
Beyers

(10) Patent No.: US 6,745,516 B2
(45) Date of Patent: Jun. 8, 2004

(54) COVER APPARATUS FOR RAIN GUTTERS

(76) Inventor: Gerald W. Beyers, 2311-20th Ave. S., Fargo, ND (US) 58102

( * ) Notice: Subject to any disclaimer, the term of this patent is extended or adjusted under 35 U.S.C. 154(b) by 0 days.

(21) Appl. No.: 09/978,433

(22) Filed: Oct. 15, 2001

(65) Prior Publication Data

US 2003/0070366 A1 Apr. 17, 2003

(51) Int. Cl.[7] ..... E04D 13/00
(52) U.S. Cl. ..... 52/12; 52/15
(58) Field of Search ..... 52/11, 12, 15

(56) References Cited

U.S. PATENT DOCUMENTS

| | | | | | |
|---|---|---|---|---|---|
| 2,526,271 | A | * | 10/1950 | Probst | 210/477 |
| 4,592,174 | A | * | 6/1986 | Hileman | 52/12 |
| 4,604,837 | A | | 8/1986 | Beam | 52/12 |
| 4,607,465 | A | * | 8/1986 | Hopkins | 52/12 |
| 5,010,696 | A | * | 4/1991 | Knittel | 52/12 |
| 5,095,666 | A | * | 3/1992 | Williams, Jr. | 52/11 |
| 5,109,640 | A | * | 5/1992 | Creson | 52/12 |
| 5,181,350 | A | | 1/1993 | Meckstroth | 52/12 |
| 5,317,843 | A | * | 6/1994 | Sheehan | 52/11 |
| 5,406,756 | A | * | 4/1995 | Bemis et al. | 52/16 |
| 5,592,783 | A | * | 1/1997 | Jones | 52/12 |
| 5,640,809 | A | * | 6/1997 | Iannelli | 52/12 |
| 5,640,810 | A | | 6/1997 | Pietersen | 52/12 |
| 5,813,173 | A | | 9/1998 | Way, Sr. | 52/12 |
| 6,182,399 | B1 | | 2/2001 | Pollera | 52/11 |
| 6,293,054 | B1 | | 9/2001 | Cangialosi | 52/12 |
| 6,427,388 | B1 | * | 8/2002 | Brochu | 52/12 |

* cited by examiner

*Primary Examiner*—Carl D. Friedman
*Assistant Examiner*—Basil Katcheves
(74) *Attorney, Agent, or Firm*—Larkin Hoffman Daly & Lindgren Ltd.; Frederick W. Niebuhr

(57) ABSTRACT

The present invention taught, enabled, described, illustrated and claimed herein comprises a continuous cover-type debris/fluid separation apparatus which is easily installed in existing, conventional trough-type gutter structures. The apparatus is configured to capture a small amount of water between two ridge features in a what is termed herein a "static pool." The first ridge is preferably formed adjacent the outer part of the gutter structure and the second ridge is formed adjacent the inner part of the gutter structure (i.e., adjacent a terminal edge of the roof of a building). The first ridge has an apex portion that is preferably is disposed at a higher elevation than an apex portion of the second ridge. The portion of the cover structure disposed between the first ridge and the second ridge thus defines the static pool region. As rainwater flowing from the terminal edge of the roof begins to fill the static pool region the rainwater naturally seeks level. As the static pool rises it first begins to flow over the second ridge toward the building. As a result, the majority of the rainwater flows "backward" toward the building, over the second ridge and through a gap formed between the cover structure and the gutter, and into the trough portion of the gutter. Meanwhile the leaves and other debris are carried "forward" by the fluid flowing away from the building. Thus, the debris and leaves are urged over the apex feature of the first ridge and past a small gap between the cover structure and the gutter, and ultimately over the lip of the gutter, so that the debris does not enter the trough portion of the gutter. The fluid that accompanies the debris and leaves passes through the small gap and is captured by the gutter.

27 Claims, 8 Drawing Sheets

10
16
24
12
12
18
14
22
20

16
32
4
34
41
36
12
4
18
10
14

COVER APPARATUS FOR RAIN GUTTERS

FIELD OF THE INVENTION

The present invention relates to apparatus and methods for handling fluid runoff from roof structures and the like. In particular, the present invention relates to an improved cover apparatus which separates fluid from debris using just the action of the fluid runoff so that leaves, sticks, tree bark and other debris are prevented from entering a gutter structure and only the fluid enters the gutter structure.

BACKGROUND OF THE INVENTION

Many prior art devices and techniques exist which attempt to solve the issue of maintaining rain gutters in a serviceable condition without requiring manual intervention. Such manual intervention typically requires the periodic clearing of debris from rain gutters and downspouts, and then rinsing and cleaning of the rain gutters. The use of mesh screens, netting, filters and the like have been used with limited success. Most prior art of this variety has the mesh screen, netting, filter and the like disposed at or near the uppermost part of the gutter structure. One such example appears in U.S. Pat. No. 4,592,174 issued Jun. 3, 1986 to Hileman. Another example having a perforated gutter liner apparatus appears in U.S. Pat. No. 6,293,054 issued Sep. 25, 2001 to Cangialosi. In the Cangialosi reference, the liner is perforated so that a second channel for the rainwater is formed within the gutter structure.

Other approaches include use of a hinged gutter cover so that when manual intervention is performed, the interior of the rain gutter is at least more readily accessed for cleaning. Such a hinged gutter cover appears in U.S. Pat. No. 5,640,810 issued Jun. 24, 1997 to Pietersen.

A prior art approach that uses both a hinged gutter system and at least two channels within the trough of a gutter structure includes U.S. Pat. No. 6,182,399 issued Feb. 6, 2001 to Pollera. In the Pollera reference, three separate trough structures are used to first capture and then divert rainwater captured by the gutter using a pivoting wing-structure that is cycled between an open and closed position.

U.S. Pat. No. 5,813,173 issued Sep. 29, 1998 to Way, Sr. and discloses an improved gutter protector which is a sheet of material having a first end extending up onto a portion of a roof. The sheet has perforations at two locations which when installed on a roof are both disposed over a part of the surface of the roof for admitting rainwater therethrough. The second end of this prior art gutter protector connects to an outer lip portion of a gutter. The two locations having perforations are formed in sections of the sheet of material having slightly different angles relative to horizontal and any debris retained on the sheet of material is supposed to be swept off manually or blown off naturally.

Other prior art approaches of the issue to separating debris from rainwater involve use of cover structures which provide a small continuous opening at or near the outer lip of the gutter structure for rain to enter the gutter and which typically are too small for debris to also enter the gutter. One such approach appears in U.S. Pat. No. 4,604,837 issued Aug. 12, 1986 to Beam in which the outer edge of the cover structure forms a temporary obstacle for the rainwater and debris. This obstacle is depicted as an upwardly curving lip so that after the obstacle is filled with rainwater the rainwater flows over the lip and down the rear of the curved structure while the debris is supposed to separate from the rainwater and fall to the ground (since the upwardly curving lip is disposed at or over the outer edge of the gutter). Another such approach appears in U.S. Pat. No. 5,181,350 issued Jan. 26, 1993 to Meckstroth. In the Meckstroth reference, the outer portion of the cover structure has a downwardly curving lip adjacent to a flange portion of the cover which supports the cover upon the outer edge of the gutter and is disposed at a lower elevation that the rest of the cover structure. Thus, the flange portion allows rainwater to run across the cover and down the curving lip structure into the gutter via an elongate slot, while the debris passes over the slot and falls to the ground.

All these prior art approaches rely on diverting water into a channel-type rain gutter structure away from the building structure while at the same time attempting to reduce the presence of debris in the gutter structure. These prior art gutter structures tend to clog, the fluid tends to splash in and around the gutter structure thereby staining and possibly damaging the fascia, and the separation of fluid from debris does not always occur without manual intervention.

SUMMARY OF THE PRESENT INVENTION

The present invention taught, enabled, described, illustrated and claimed herein comprises a continuous cover-type debris/fluid separation apparatus which is easily installed in existing, conventional trough-type gutter structures. The apparatus is configured to capture a small amount of water between two ridge features in a what is termed herein a "static pool." The first ridge is preferably formed adjacent the outer part of the gutter structure and the second ridge is formed adjacent the inner part of the gutter structure (i.e., adjacent a terminal edge of the roof of a building). The first ridge has an apex portion that is preferably disposed at a higher elevation than an apex portion of the second ridge. The portion of the cover structure disposed between the first ridge and the second ridge thus defines the static pool region. As rainwater flowing from the terminal edge of the roof begins to fill the static pool region a primary fluid flow (designed $P_p$ in the appended drawings) is established with a flow direction away from the building. As the static pool fills with rainwater the fluid present in the static pool region naturally seeks level, regardless of the primary fluid flow. According to the present invention, as the level of rainwater in the static pool rises farther it first begins to flow over the second ridge toward the building. This secondary fluid flow toward the building (designated $P_s$ in the appended drawings) generally has a lower magnitude flow rate than the primary fluid flow. The rainwater thus descends through a relatively larger gap formed between the cover structure and the building-side upper gutter lip feature. Meanwhile, a combination of rainwater and debris which is subjected to the primary fluid flow is driven over the first ridge and the fluid descends through the relatively smaller gap formed between the cover structure and the outer gutter lip structure. Due to the primary fluid flow and the small size of the gap adjacent the first ridge, the vast majority of debris is propelled past the gap and ultimately over the outer gutter lip structure and the debris then either falls harmlessly to the ground or is removed naturally by the wind. Any debris remaining will typically dry out over time so that it is readily naturally eliminated via wind and weather.

In addition, when rainwater enters the static pool the likelihood of splashing of droplets of rainwater from the static pool is greatly reduced (as compared to a bare section of covering material), thus reducing the weathering of the fascia structure and related portions of the roof and the building adjacent the gutter. The static pool creates an attraction to the rainwater flowing from the roof and temporarily supports (or "floats") debris that accompanies the primary flow of rainwater. Once the static pool fills to the level of the second ridge, a secondary flow of rainwater flows "backward" (toward the building), over the second ridge, through a gap formed between the cover structure and the gutter, and into the trough portion of the gutter. While the leaves and other debris are carried "forward" by the primary fluid flow (away from the building).

The debris and leaves are thus fluidly urged over the apex feature of the first ridge and past a relatively smaller gap between the cover structure and the gutter, and ultimately over the lip of the gutter so that the debris does not enter the trough portion of the gutter.

To accommodate a large volume of rainwater flowing from the roof and onto the cover structure both gaps operate to drain the cover structure. Some of the rainwater will enter the gutter by passing over the first ridge and entering the gutter through the small gap formed between the cover structure and the lip of the gutter while some of the rainwater will drain over the second ridge where it is then captured in the trough of the gutter. In one preferred embodiment, the relatively smaller gap formed near the first ridge is approximately one-eighth of an inch (⅛") and the gap formed near the second ridge is approximately one-quarter inch (¼").

BRIEF DESCRIPTION OF THE DRAWINGS

In the drawings which accompany this disclosure, like numerals are used to refer to similar components throughout the written description and the features are not drawn to scale. Furthermore, the illustrated embodiments are intended to illuminate the basic inventive concept as embodied in the depicted structure for those of skill in the art to which the invention is directed. Even though not illustrated herein, other structures and methods of fabrication and use of the present invention are also intended to be covered hereby. The appended claims alone define the metes and bounds of the present invention as interpreted by a person of skill in the art to which the invention is directed.

DETAILED DESCRIPTION OF THE ILLUSTRATED EMBODIMENTS

Figure 1:
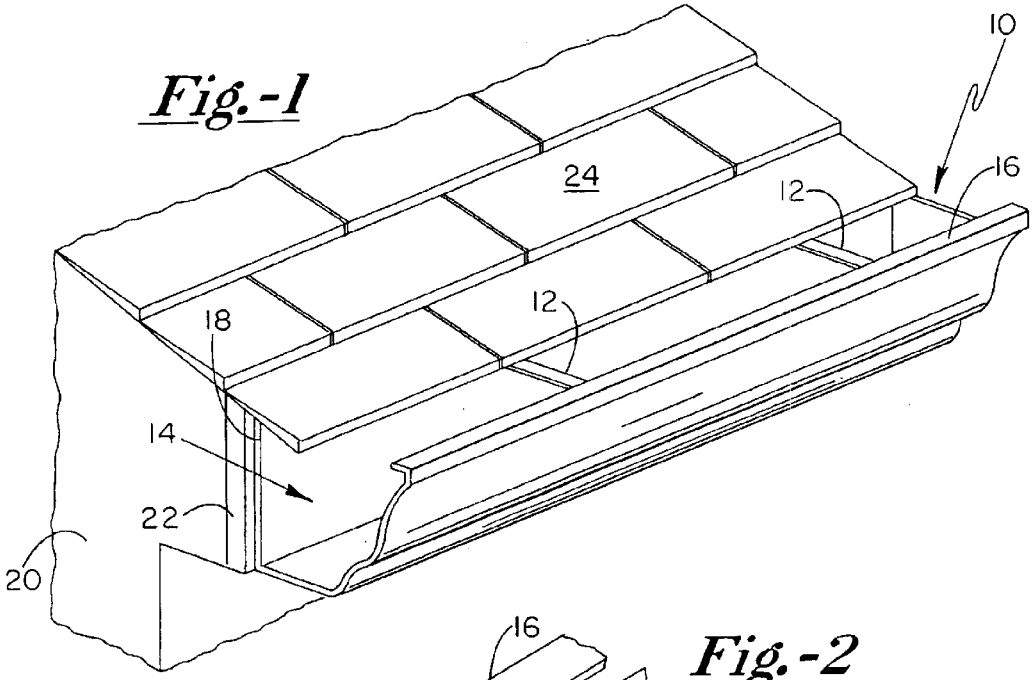
FIG. 1 depicts a traditional, prior art configuration of a gutter attached to a portion of a building adjacent a terminal edge of a roof of the building.

In FIG. 1 a prior art combination of a gutter 10, having a upwardly extending outer lip portion 16 and an upwardly extending inner lip portion 18 coupled together via a series of gutter hangers 12 which also serve to connect the gutter 10 to the fascia 22 of a building 20 adjacent a terminal edge of roof 24. The typical gutter 10 is a channel- or trough-type structure having a relatively large trough portion 14 for collecting rainwater and debris that washes down from the roof 24.

Figure 2:
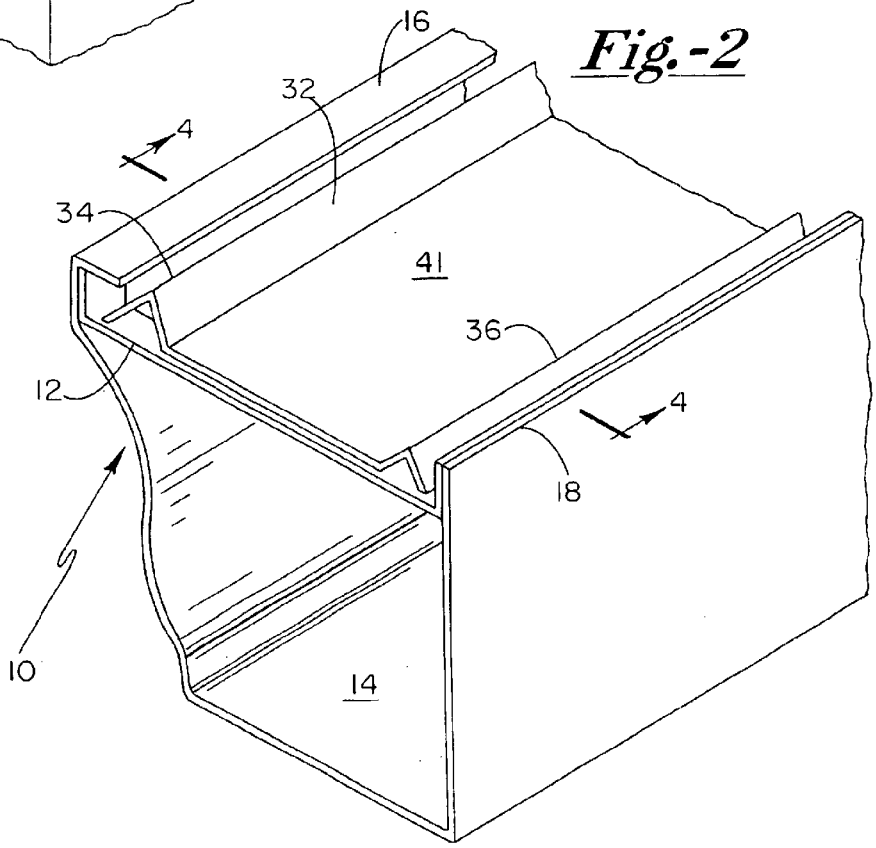
FIG. 2 is a perspective view of the improved cover structure according to the present invention as coupled to a gutter.

Referring now to FIG. 2, which is a perspective view of the elements of the improved cover apparatus 30 of the present invention. The cover apparatus 30 is used for separating debris 28 from rainwater or other fluid 26 flowing from a roof 24 into the trough 14 of a gutter 10 without appreciably slowing or changing the typical performance of the gutter 10. In operation the apparatus of the present invention initially receives fluid 26 runoff, including incidental debris 28, from the roof 24 in a central portion 41 of the cover apparatus 30. The cover apparatus 30 functions primarily to direct fluid 26 into the gutter 10 in a direction across the gutter 10 (i.e., toward and away from the lip portions 16,18) and not in the traditional longitudinal direction to or from the terminal ends of the gutter 10. The terminal ends of said cover structure 30 are preferably fitted to the gutter 10 so that said terminal ends fit more or less flush to the interior vertical end portion of said gutter 10. However, the cover structure 30 may be bounded on either or both ends thereof by an end cap (not shown in FIG. 2) as described in more detail hereinbelow in reference to FIG. 8. In any event, the fluid 26 impinging upon the cover structure 30 first forms a "static pool" 40 in a substantially flat central region 41 therein as more fully described, taught, enabled and illustrated herein (specifically in FIG. 3). The gutter 10 can be of any suitable design as is known and used in the art that is configured generally as a channel-type, or trough-type collection mechanism for fluid 26 flowing from a roof 24. Such a gutter 10 typically has an upwardly extending outer lip portion 16 and an upwardly extending inner lip portion 18 and a series of gutter supports, or gutter hangers 12, disposed from the outer lip portion 16 to the inner lip portion 18 (although only one such hanger 12 is depicted in FIG. 2).

Figure 3:
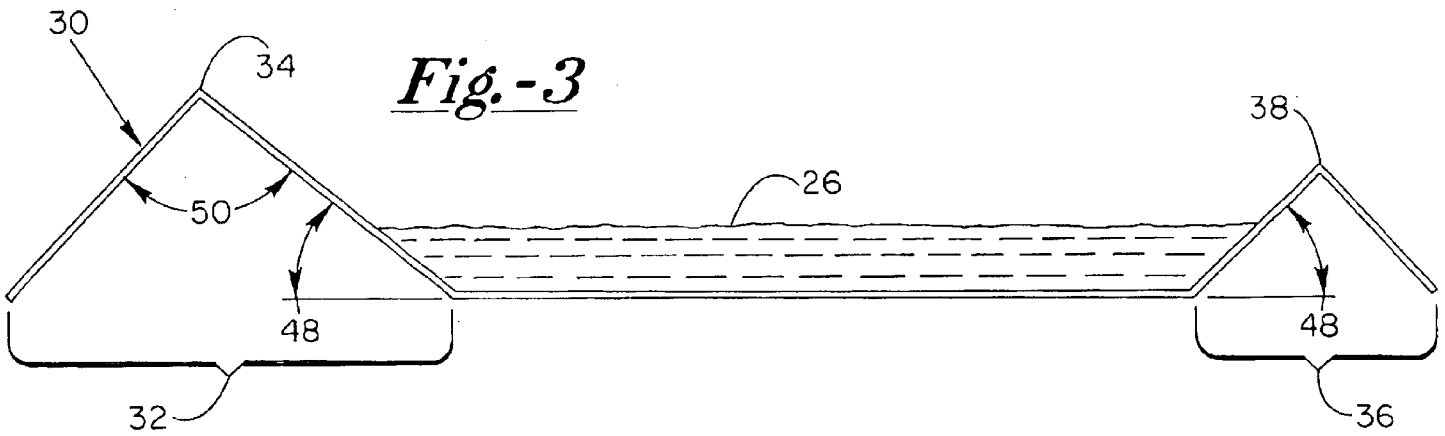
FIG. 3 is an elevational side view of the improved cover structure of the present invention illustrating the relative dimensions of the cover structure and depicting a volume of fluid resident in the static pool portion of the cover structure.
Figure 4:
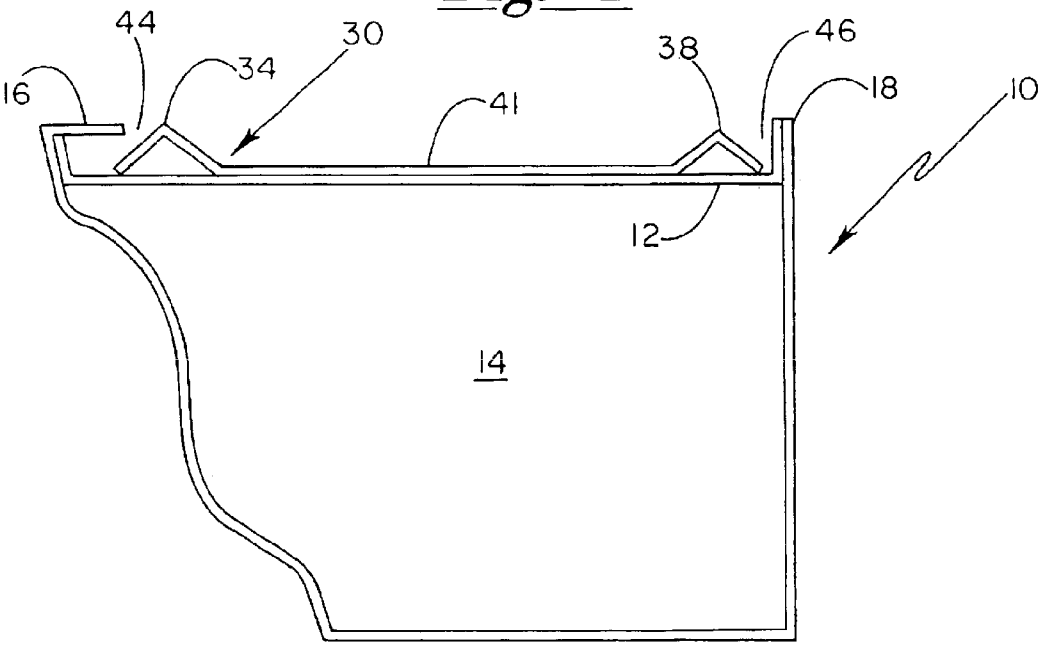
FIG. 4 is an elevational side view of the improved cover structure of the present invention disposed in a typical trough-, or channel-type gutter structure.

Referring now to FIG. 3 and FIG. 4, the cover structure 30 has a first longitudinal ridge feature 32 formed adjacent the outer lip portion 16 of a gutter 10 and a second longitudinal ridge feature 36 spaced from the first longitudinal ridge feature 32 and formed adjacent the inner lip portion 18 of the gutter 10. The cover structure 30 preferably is designed and configured with respect to the dimensions of the gutter 10 so that when assembled to the gutter 10 a first gap 44 is defined between the first longitudinal ridge feature 32 and the outer lip portion 16. Also, a second gap 46 is defined between the second longitudinal ridge feature 36 and the inner lip portion 18. The present invention preferably comprises an elongate cover structure 30 that has no seams or junctions formed in the cover structure 30 for any given length of gutter 10. The first longitudinal ridge feature 32 has an apex portion 34 disposed approximately at the elevation of the outer lip portion 16 and the second longitudinal ridge feature 36 has an apex portion 38 that is disposed at a lower elevation than the apex portion 34 of the first ridge feature 32. The cover structure 30 is preferably disposed adjacent to the roof 24 so that the fluid 26 flows directly onto an intermediate flat portion 41 of the elongate cover structure 30 disposed between the first and second longitudinal ridge features 32,36. The intermediate portion 41 is where the static pool 40 of fluid 26 forms. Of course, according to the present invention the portion 41 may have minor ridge features or undulations (as shown in FIG. 7) formed therein as long as the portion 41 has a lower elevation than the first and second apex 34,38 to at least temporarily permit a static pool 40 of fluid to form thereon.

In one embodiment of the present invention, the cover apparatus 30 is disposed relative to the gutter 10 to form the first gap 44 with a dimension of approximately one-eighth of an inch (⅛") across. In a related embodiment, the cover apparatus 30 is disposed relative to the gutter to form the second gap 46 is approximately one-quarter of an inch (¼") across. In another embodiment for fabricating the cover structure 30 of the of the present invention, the sides of the apex features 34,38 forming both said first and said second of said ridge features 32,36 forms an angle (depicted by reference numeral 50) of approximately ninety degrees in said substantially flat sheet material 58. In one form of the method of fabricating the cover structure 30 of the present invention, wherein a base of said first ridge feature and a base of said second ridge feature are spaced apart approximately two and one-fourth inches.

Figure 9:
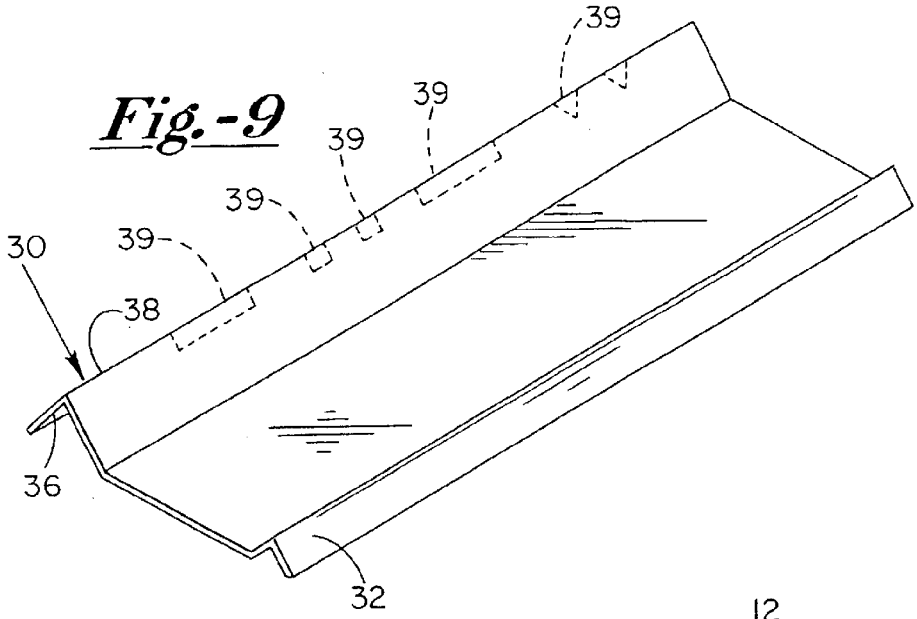
FIG. 9 is a perspective view of an alternate embodiment of an apex feature of the second ridge feature constructed according to the present invention.

With reference again to FIG. 3, in one embodiment of the cover structure of the present invention, the apex portion 38 of the second longitudinal ridge feature 36 is approximately half of the elevation of the apex portion 34 of the first longitudinal ridge feature 34. In the form of the invention depicted in FIG. 3, the first and the second longitudinal ridge features 32,36 are each disposed at an angle 48 of approximately twenty-two degrees from a plane extending from the intermediate portion 41 of the elongate cover structure 30 (although a variety of other angles may be used). Of course, the angle 48 of each apex portion 34,38 may differ or may be the same angle 48 for each apex portion 34,38. Likewise, a different angle 50 may be used for the first and the second longitudinal ridge feature 32,36 or the edge of the portion 41 may gradually curve over a gradual transition region with the ridge features 32,36. Several other variations of the shape and configuration are depicted in FIG. 7 and FIG. 9. In the embodiment of the present invention depicted in FIG. 3, the portion 40 of the cover apparatus 30 has a lateral dimension of approximately two and one-fourth inches (2¼"). The topography of the apex features 24,28 may be such that each side of the apex features 24,28 form an angle 50 as noted above, such as a ninety degree angle, or in lieu of an angle 50 may have be a curving shape in cross section (such as the shape depicted in FIG. 7(*b*) or FIG. 7(*c*) (wherein said radius is depicted by arrow 52). Said radius 52 may have constant magnitude or may vary (i.e., form a decreasing-radius curved shape or an increasing-radius shape). However, and as noted above with respect to the transition region of the cover apparatus 30 where the portion 41 meets the ridge features 32,36, the apex features 24,28 of the first and second longitudinal ridge features 32,36 may comprise a gradual curved portion formed in the elongate cover structure 30 or any other convenient angle.

The cover structure 30 of the present invention may be fabricated from a wide variety of materials, but the material is preferably susceptible of fabrication on-site at or near the building from a continuous roll of such material. By example and without limitation, the elongate cover structure 30 may be formed of a sheet of one the following materials: a metal material, a resin-based material, a composite material, a metallic alloy material, a ceramic material, a wooden material, a glass material, a fiber-reinforced material, a plastic material, a molded material, an aluminum material, a polymer material, a paper-coated material, a material having a low friction surface, a waterproof material, a magnetic material, a magnetized material, an electrically conducting material, an impregnated fabric material, or a combination of any of the foregoing materials.

The present invention also includes methods of assembling the cover structure 30 to a gutter 10 previously installed on a building 20 and for initial installations of a gutter 10 for use therewith. In this method, a technique for assembling an elongate cover structure 30 for separating debris 28 from rainwater or other fluid 26 flowing into a gutter 10 that forms a trough 14 adjacent a roof 24 is disclosed, described, enabled, taught, illustrated and claimed herein. This method of assembly of a cover structure 30 to a previously installed gutter 10 requires only a gutter 10 having an outer lip portion 16 and an inner lip portion 18 and a series of gutter supports or hangers 12, disposed from the outer lip 16 portion to the inner lip portion 18.

This method of assembly includes the following: placing a cover structure 30 on top of at least two of said gutter supports 12 so that a first gap 44 and a second gap 46 are formed between lateral edges of the cover structure 30 and adjacent lip portions 16,18 of the gutter 10 and optionally connecting the cover structure 30 to at least one of the gutter hangers 12. In this method, the cover structure 30 preferably comprises an elongate cover structure 30 disposed on said series of gutter supports 12 and having a first longitudinal ridge feature 32 formed adjacent the outer lip portion 16 of a gutter 10 and a second longitudinal ridge feature 36 formed adjacent the inner lip portion 18 of the gutter 10 so that a first gap 44 is defined between a terminal edge of the first longitudinal ridge feature 32 and the outer lip portion 16 and a second gap 46 is defined between the second longitudinal ridge feature 36 and the inner lip portion 18.

A method for assembling a cover structure 30 to a newly installed, or initial, system of gutters 10 on a building 20 is similar to the method described above, except that the cover structure 30 may be simultaneously fitted to the gutter 10 as the gutter 10 is attached to the fascia 22 or other portion of the building 20. That is, the cover structure 30 may be created at about the same time as that the gutter 10 is fabricated and the cover structure may be customized for the gutter 10. For example, if the gutter is fabricated with a particular spacing or elevation for the hangers 12 due to the construction of the roof 24 or shape and location of the fascia 22, the cover structure 30 can readily be designed and constructed in such a way that the cover structure 30 accounts for such particular spacing and elevation. Or, in the alternative, the cover structure 30 may be fabricated as illustrated and described with reference to FIG. 10 (hereinbelow) such that some or all of the hangers 12 for the gutter 10 may be incorporated into the cover structure.

Figure 5A:
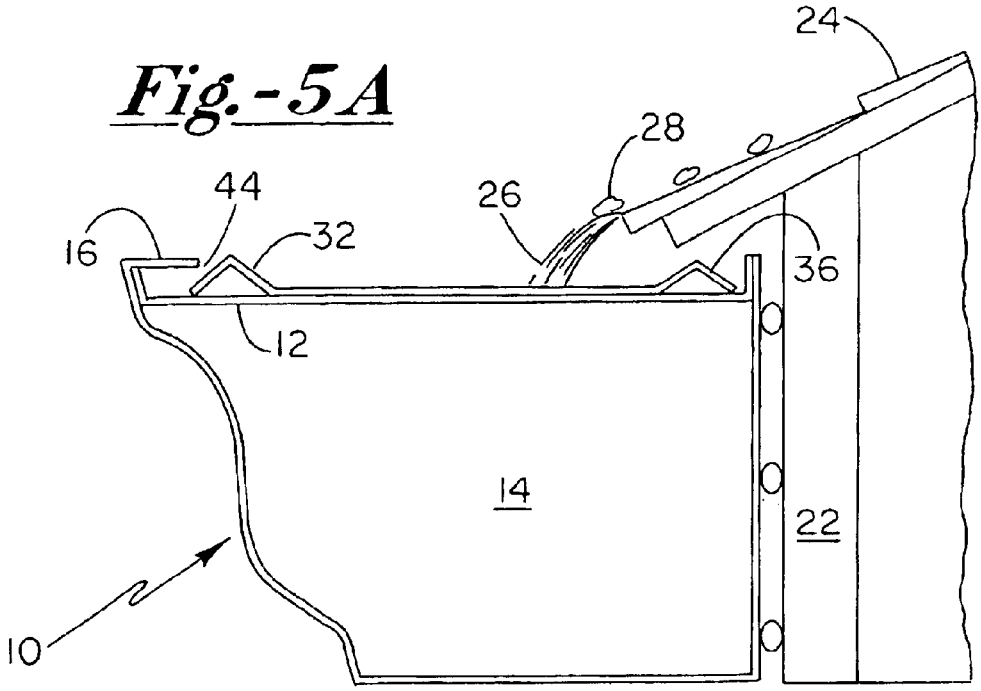
FIG. 5*a* through FIG. 5*d* are elevational side views of the improved cover structure of the present invention disposed in a typical trough-, or channel-type gutter structure and depict how the cover structure operates as progressively more fluid (and some debris) impinges upon the cover structure.

Referring now to FIG. 5*a* through FIG. 5*d*, in another form of a method for handling runoff of fluid 26 from a roof 24 of a building 20 adjacent to a trough structure 14, comprises the following steps:

First, as illustrated in FIG. 5*a*, the method begins by placing an elongate cover structure 30 over a top portion of the trough structure 14 of the gutter 10 and preferably disposed on the gutter hangers 12. The cover structure 30 may optionally be coupled to the gutter 10 using mechanical, adhesive, magnetic and other coupling techniques and the like. The cover structure 30 may be placed with spacer members (not shown) at the edges of the cover structure 30 to retain the cover structure 30 in the desired position relative to the gutter 10.

Figure 5B:
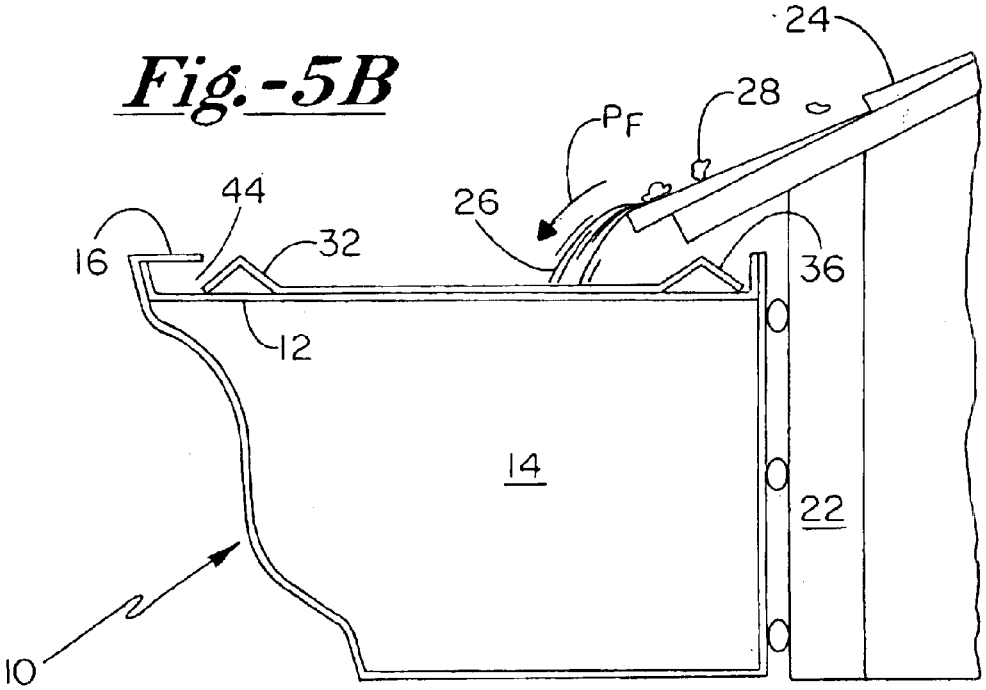

Second, as illustrated in FIG. 5*b*, temporarily collecting a portion of the fluid 26 runoff (i.e., a "static pool") in a fluid collection region 41 of the elongate cover structure 30, wherein said fluid collection region 41 is disposed between a pair of elongate ridges 32,36 formed in said elongate cover structure 30. During the initial collection of fluid 26, a primary fluid flow (designated "Pp" in FIG. 5*b*) begins to become established. This primary fluid flow results directly from the fluid runoff from the roof 24 and substantially transverse to the longitudinal axis of the gutter 10 (i.e., is directed toward the first elongate ridge 32) and away from the building 20.

Figure 5C:
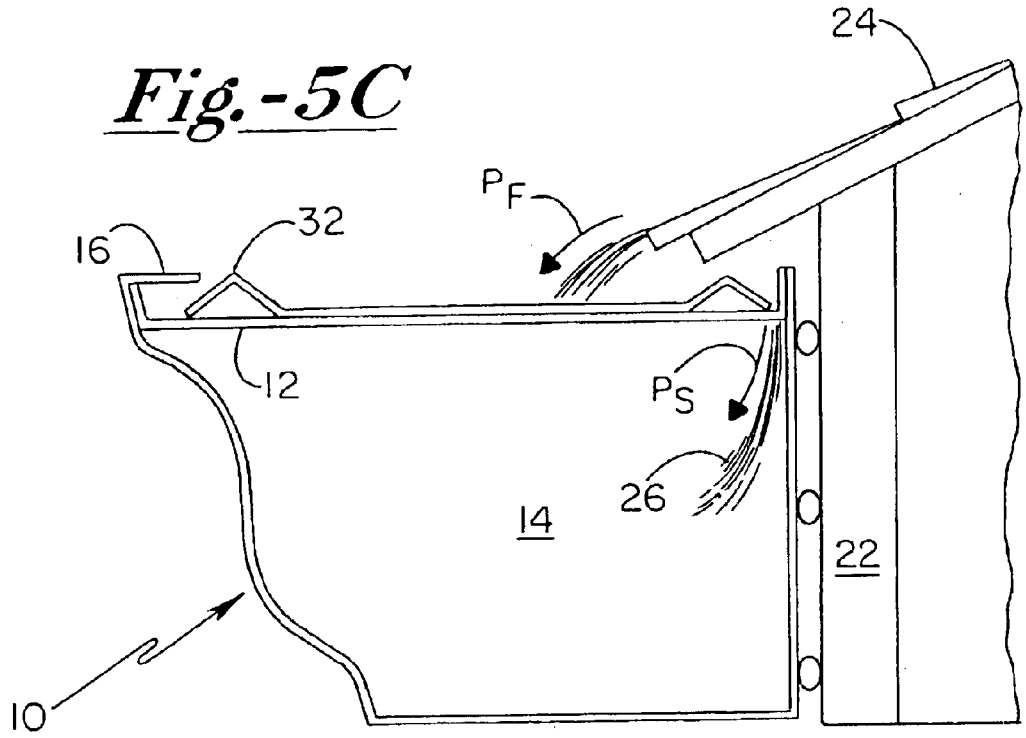

Third, as illustrated in FIG. 5*c*, draining a portion of said fluid 26 runoff over the ridge feature 36 of the pair of elongate ridges 32,36, which ridge feature 36 is disposed at a lower elevation than the other ridge feature 32, so that said portion of fluid 26 descends into the trough 14. During the draining step a secondary fluid flow (designated "Ps" in FIG. 5*c*) is established when the fluid 26 reaches the apex 38 of the second ridge feature 36. The magnitude of the secondary fluid flow is typically less than the magnitude of the primary fluid flow so that almost exclusively, only fluid 26, and not debris 28, are affected by the secondary fluid flow. In addition, since most debris 28 typically enters a gutter 10 during and immediately following a heavy downpour of rain, the cover structure 30 of the present invention is designed to take advantage of this phenomenon with the dual, opposing fluid flows: primary (mainly for separation of debris 28) and secondary (mainly for elimination of fluid 26).

Figure 5D:
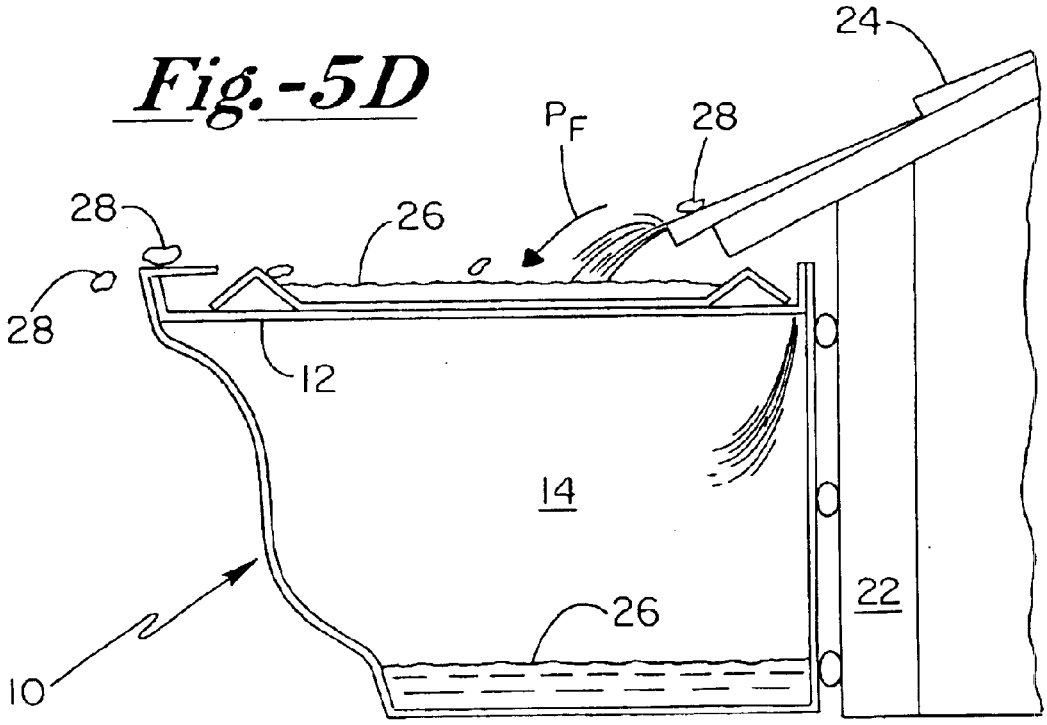

Fourth, as illustrated in FIG. 5*d* and due mainly to the primary fluid flow, fluidly urging a plurality of non-fluid debris 28 to drain over the relatively higher elevation ridge feature 32 so that a majority of said non-fluid debris 28 is not retained in the static pool 40 or the collection region 41 and does not reach the trough structure 14 of the gutter 10. To the extent that the primary fluid flow forces any fluid 26 over the apex 34 of the first ridge 32 such fluid 26 will enter the first gap 44 and descend directly and collect in the trough 14 of the gutter 10 before flowing to a downspout or other fluid disposal location. In a further refinement of the above-described method, said elongate cover structure 30 is disposed over at least two trough hanger elements 12 which connect the trough 14 of the gutter 10 to a portion 22 of the building 20. Said cover structure 30 is preferably not otherwise connected to said trough structure 14, gutter 10 or said building 20.

Figure 6:
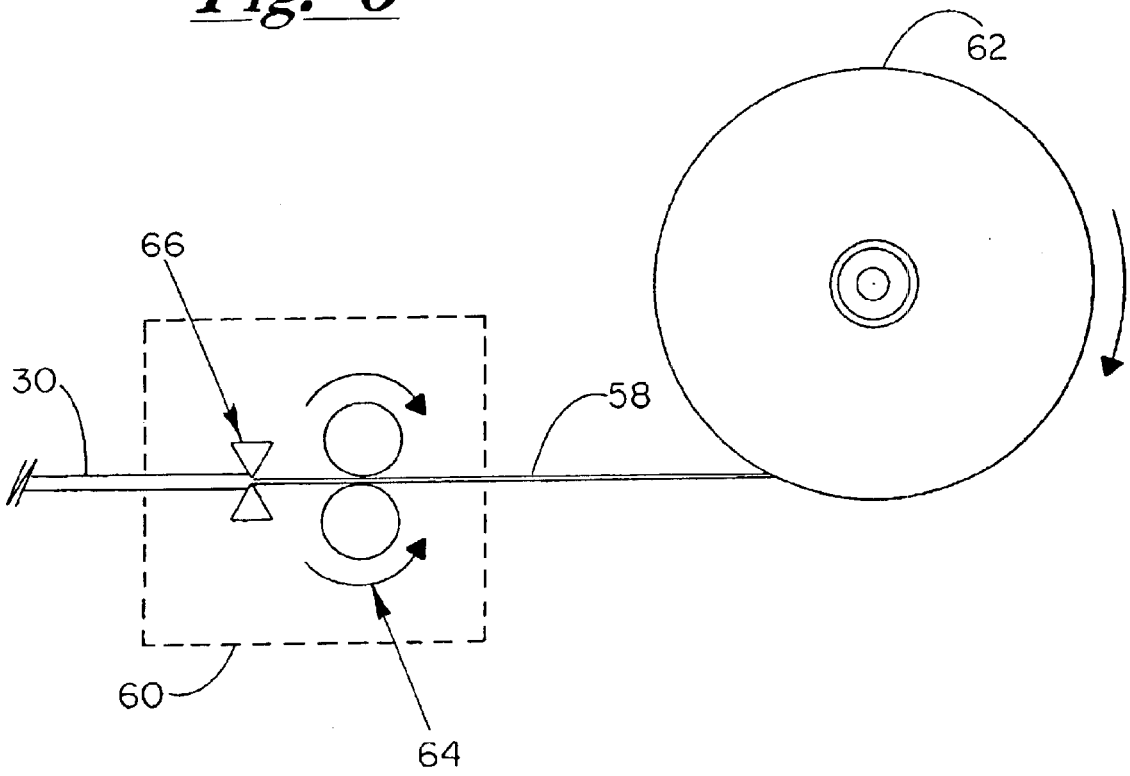
FIG. 6 is an elevational side view depicting basic elements for performing a method of fabricating a cover structure according to the present invention, and in which a length of raw material is fed into a extruding mechanism having operative elements for forming the pair of longitudinal ridge features of the cover structure of the present invention.

Referring now to FIG. 6, the present invention includes apparatus and methods of fabrication and use of the cover structure 30 described, enabled, taught, illustrated and claimed herein. The methods of use are set forth above. A method of fabricating a cover structure 30 for separating debris 28 from rainwater or other fluid 26 flowing into a gutter 10 is now introduced. In this method, the cover structure 30 forms a trough 14 adjacent a roof 24 and the gutter 10 has an outer lip portion 16 and an inner lip portion 18 and a series of gutter supports 12 disposed from the outer lip portion 16 to the inner lip portion 18. A method of fabricating such a cover structure 30 comprises the following steps: First, aligning a length of substantially flat sheet material 58 with an extruding mechanism 60 which extruding mechanism 60 is adapted to form longitudinal ridges 32,36 in said substantially flat sheet material 58. Second, adjusting the extruding mechanism 60 to form at least two spaced apart longitudinal ridge features 32,36 in said sheet material 58; wherein a first of said ridge features 32 has an apex 34 and a second of said ridge features 36 has an apex 38 disposed at a lower elevation than the apex 34 of said first ridge feature 32. In the method just set forth, the length of substantially flat sheet material 58 is an uncoiled length of a continuous roll 62 of such material 58. Preferably, the continuous roll 62 of material is a roll of aluminum material. In one embodiment of the method just set forth, the first and the second of said ridge features 32,36 are each disposed at approximately a twenty-two degree angle from a central portion 41 of the substantially flat sheet material 58. The continuous roll 62 of material may be electrically or manually powered to assist dispensing the material and feeding it into the extruding mechanism 60. The extruding mechanism may also have apparatus for propelling the material therethrough (as denoted by referenced numeral 64) which apparatus does not disfigure the material but merely propels it through the operative material-forming dies 66 (or other mechanical material-forming tools). The extruding process is designed to be portable so that the required length of a cover structure 30 for any given gutter 10 may be fabricated at the location where the gutter 10 is located.

FIG. 7*a* through FIG. 7*f* are elevational side views of the lateral profile of several alternate embodiments of the cover structure 30 of the present invention. These illustrated alternative embodiments are intended to demonstrate several forms of the present invention for those of skill in the art and are not to be interpreted as limiting, but rather as exemplary of other forms of the invention covered by the present disclosure and claims. In each of these illustrations, a cover structure 30 is depicted that has a first longitudinal ridge feature 32, an intermediate portion 41 and a second longitudinal ridge feature 36.

Figure 7A:
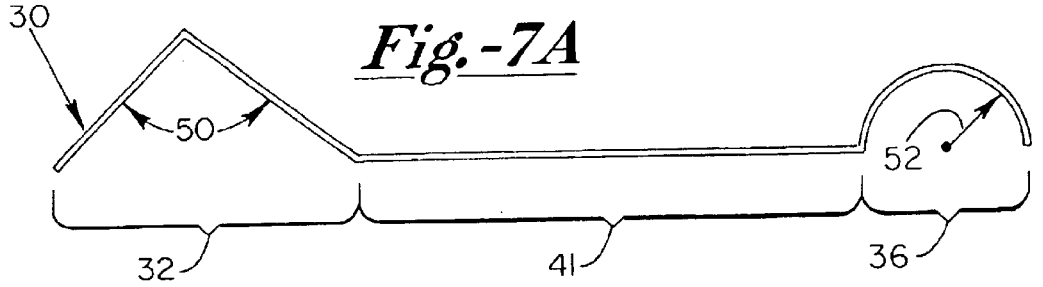
FIG. 7*a* through FIG. 7*f* are elevational side views of the lateral profile of several alternate embodiments of the present invention.

In FIG. 7*a*, an embodiment of the present invention has a gradually curving second ridge feature 36 adjacent the intermediate portion 41, but otherwise is designed to function substantially as described elsewhere in this disclosure. The second ridge feature 36 has a radius depicted an arrow 52.

Figure 7B:
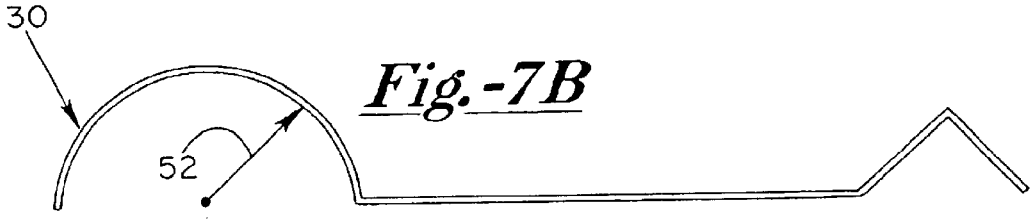

In FIG. 7*b*, an embodiment of the present invention has a gradually curving first ridge feature 32 adjacent the intermediate portion 41, but otherwise is designed to function substantially as described elsewhere in this disclosure. The first ridge 32 has an interior angle from a first side to a second side thereof depicted by reference numeral 50, which preferably equals approximately ninety degrees.

Figure 7C:
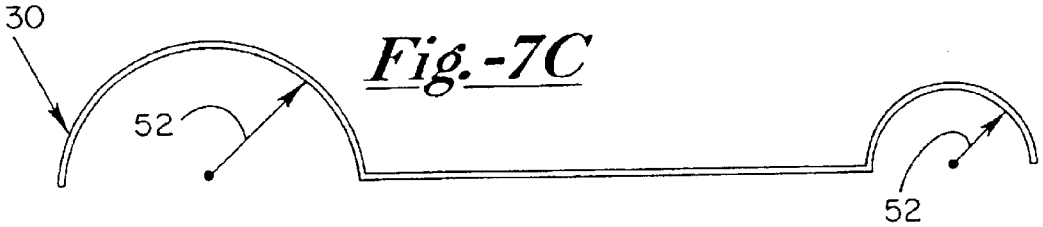

In FIG. 7*c*, an embodiment of the present invention has a gradually curving first and second ridge feature 32,36 adjacent each lateral side of the intermediate portion 41, but otherwise is designed to function substantially as described elsewhere in this disclosure. As depicted in FIG. 7*c*, the first and second ridge features 32,36 have a radius depicted by arrow 52 (the magnitude of which differs for the first and second ridge features 32,36.

Figure 7D:
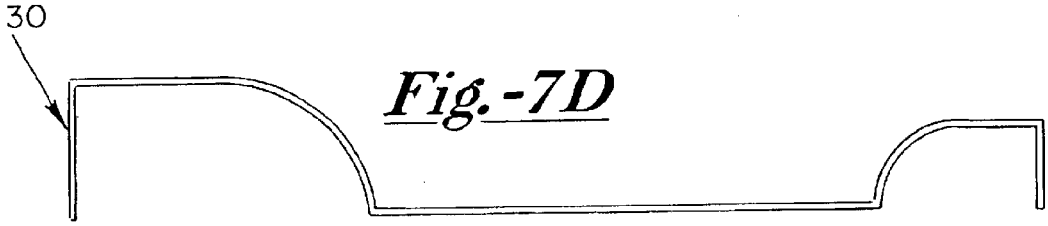

In FIG. 7*d*, an embodiment of the present invention has a gradually curving first portion of said first and second ridge 32,36 adjacent the intermediate portion 41 and a substantially straight terminal portion at each lateral side of the first and second ridge 32,36, but otherwise is designed to function substantially as described elsewhere in this disclosure.

Figure 7E:
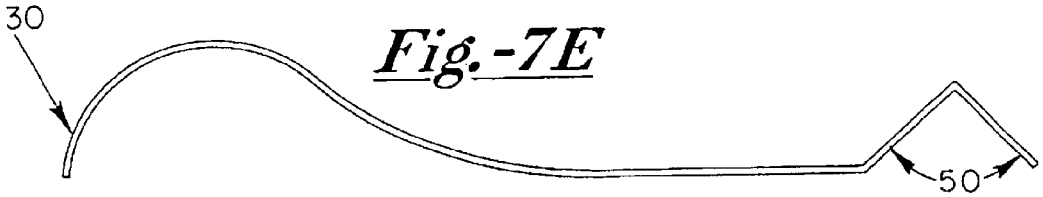

In FIG. 7*e*, an embodiment of the present invention has a gradually curving first ridge feature 32 which gradually transitions toward the location of the intermediate portion 41. The intermediate portion 41 continues the shape of the first ridge over substantially the entire surface of intermediate portion 41, but otherwise is designed to function substantially as described elsewhere in this disclosure. As depicted in FIG. 7*e*, the second ridge 36 has the preferred shape for the apex portion thereof as indicated by the angle 50 between the two sides of the first ridge 36, although as depicted said angle 50 is a bit less than ninety degrees.

Figure 7F:
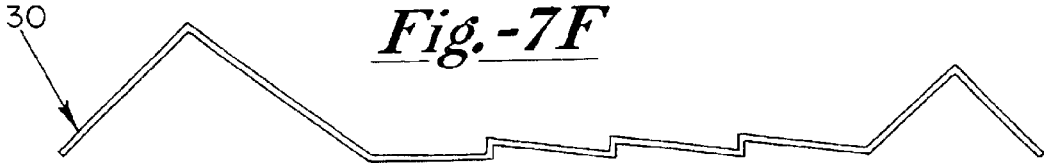
Figure 8A:
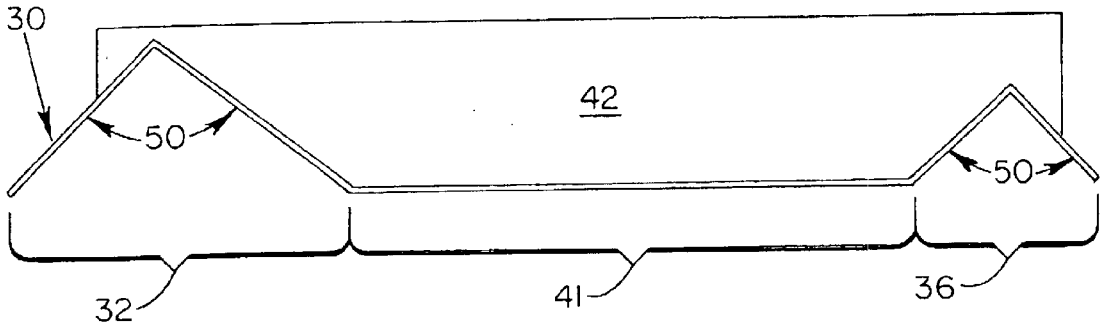
FIG. 8*a* through FIG. 8*d* are elevational side views of an optional end cap member disposed at a terminal end of a cover structure constructed according to the present invention (taken along the line 8—8 of FIG. 2).
Figure 8B:
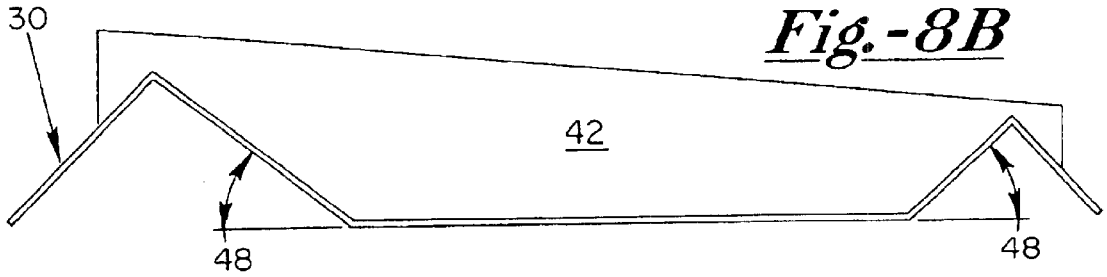
Figure 8C:
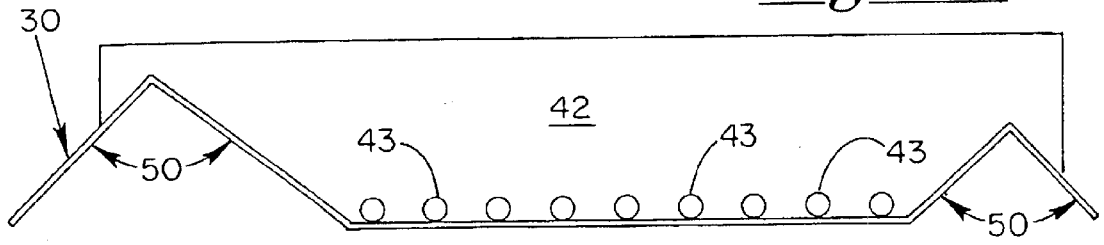
Figure 8D:
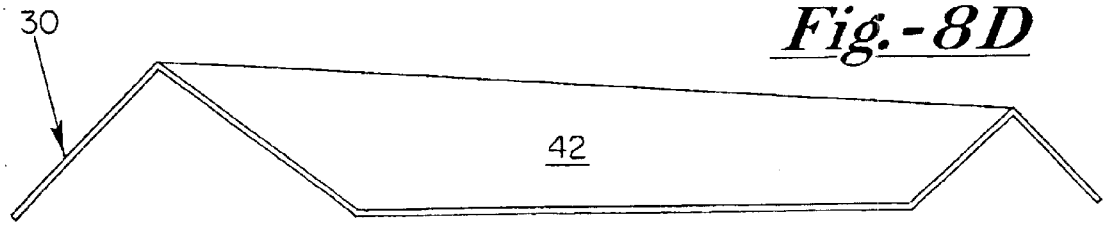

In FIG. 7*f*, an embodiment of the present invention has a jagged-shaped surface over the majority of the intermediate portion 41. Said jagged-shaped surface terminates at the first ridge feature 36, and each individual jagged portion is intended to promote the movement of debris 28 accumulated on the intermediate portion 41 to move toward the first ridge 32. While individual abrupt jagged-shapes are shown in FIG. 7*f*, such shapes may be formed as longitudinal grooves, striations, undulations, ribs and the like.

As noted above with respect to FIG. 2, and now with reference to FIG. 8, the cover apparatus 30 according to the present invention may also include at least one upwardly extending end cap structure 42 sealingly coupled to a first end of the elongate cover structure 30 and preferably having a top portion disposed at an elevation at least as great as the elevation of the first apex 34 of the first longitudinal ridge feature 32. In most installations of the gutter 10 and the cover structure 30 a slight camber more or less centered for any given section of gutter 10 so that fluid 26 flows from the cambered center portion to the lower elevation end portions. The gutter 10 may be inclined toward a downspout (not shown) or other fluid collection location. Accordingly, the cover structure 30 typically and preferably terminates at the ends of said gutter with substantially no gap occurring therebetween. Of course (and as depicted in FIG. 8*b* and FIG. 8*d*), an end cap member 42 may be coupled to the cover structure 30 and, if so, will preferably have an inclined upper elevation such that the top portion of the end cap 42 more or less has the same elevation as the apex 34 of the first ridge 32 at one end and the same elevation as the apex 38 of the second ridge 36. The end cap 42 may of course have a top elevation greater than the elevation of the apex. The end cap 42 may be an upwardly extending integral portion of the cover structure 30 or may be separate component. Furthermore, the end cap 42 may be perforated (depicted by reference numeral 43)or provided with filtering media such as mesh screen, coiled wire and the like (not shown) so that when the fluid 26 is no longer flowing from the roof 24 onto the cover structure 30, the fluid may more or less dissipate and not remain on portion 41 nor form a static pool 40 of fluid 26. As is known and used in the art, a gutter 10 typically is coupled to a support structure such as a portion of fascia 22 of a building 20 with a slight incline to promote complete elimination of fluid 26 from a lower elevation end of the gutter 10. Accordingly, in some embodiments of the invention a non-perforated end cap 42 may be disposed at the higher elevation end of the gutter 10 and a perforated end cap 42 may be disposed at the lower elevation end of the gutter 10.

FIG. 9 is a perspective view of an alternate embodiment of an apex feature 38 of the second ridge feature 36 constructed according to the present invention. In FIG. 9, in lieu of the common elevation of the apex 38 of the second ridge 36 as depicted and described, this form of the apex 38 may be fabricated with one or more portions of lower elevation 39 (depicted in ghost in FIG. 9). These portions of lower elevation 39 provide discrete channels for the fluid 26 resident in the static pool 40 to escape from the intermediate region 41 of the cover structure 30. Such portions of lower elevation 39 thus allow the fluid 26 to initially gradually begin to drain into the gap 46 and more rapidly drain until the level of the fluid 26 reaches the top of the apex 38 at which time maximum flow of the secondary fluid flow occurs (during particularly high volume runoff events). The spacing of such portions of lower elevation 39 may vary according to the desired flow characteristics of the fluid 26 into the trough 14 of the gutter 10. Likewise the shape of such portions 39 may likewise vary to create a more or less gradual increase in the second fluid flow (e.g., rectangular versus a tapered "V" shape). While not depicted in FIG. 9, such portions of lower elevation 39 may be disposed on the first ridge feature 32.

Figure 10A:
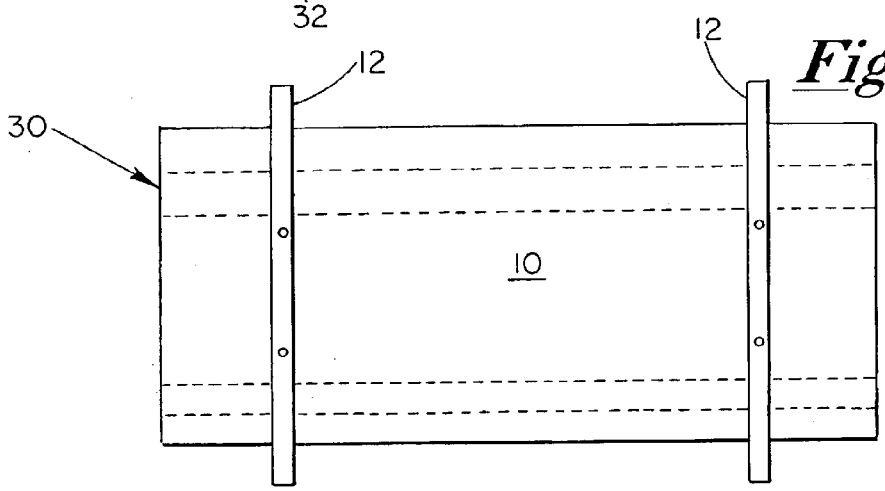
FIG. 10*a* and FIG. 10*b* are plan views of the bottom portion of an embodiment of a cover structure constructed according to the present invention in which the cover structure incorporates gutter hanger elements.
Figure 10B:
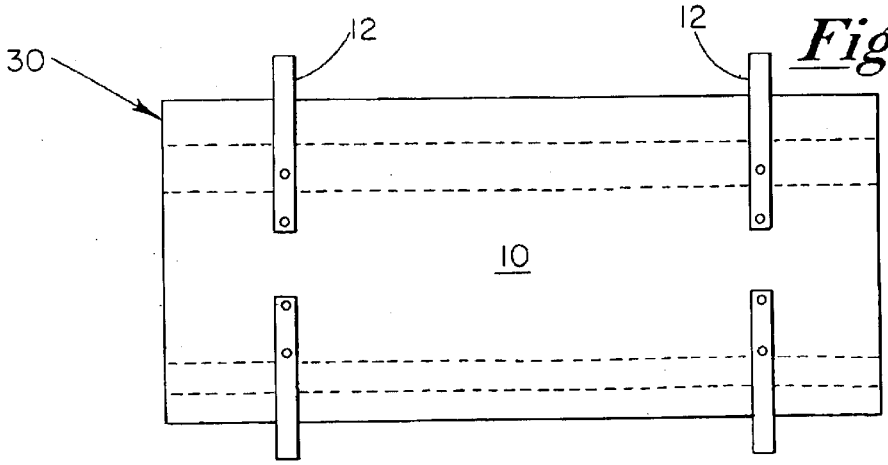

FIG. 10*a* and FIG. 10*b* are plan views of the bottom portion of an embodiment of a cover structure 30 constructed according to the present invention in which the cover structure 30 incorporates gutter hanger elements 12. In FIG. 10*a*, the hangers 12 are fastened to a portion of the bottom of cover structure using solder, welds, adhesive or the like and said hangers 12 are unitary pieces which span the entire width of the cover structure 30. In FIG. 10*b*, such hangers 12 do not span the entire width of the cover structure 30 but are rather short sections of material that are fastened to the bottom on the cover structure 30 and are adapted to connect the cover structure to the gutter 10 and the gutter 10 to the fascia 22 (or other gutter-supporting structure of the building 20). While the hangers 12 depicted in FIG. 10*b* are aligned, they may be offset and still function in the traditional manner for typical hangers 12.

In an additional form of the present invention, the cover structure 30 is either fabricated from an electrically conducting material or has several segments of an electrically resistive material coupled thereto so that a low voltage electrical current may be periodically infused into the cover structure 30 and/or the electrically resistive material to promote melting of ice, snow, sleet and/or hail if and when such material accumulates on, in or below the cover structure. While not a primary object of the present invention, this aspect of the invention allows for year round advantageous performance of the cover structure.

Additional advantages and modifications of the present invention will readily occur to those skilled in the art. The present invention in its broader aspects is, therefore, not limited to the specific details, representative apparatus and illustrative examples shown and described. Accordingly, departures from such details may be made without departing from the spirit or scope of the applicant's general inventive concept and are intended to be covered hereby.

I claim:

1. An apparatus for separating debris from rainwater or other fluid flowing into a gutter that forms a trough adjacent a roof and wherein the gutter has an outer lip portion and an inner lip portion and a series of gutter supports disposed from the outer lip portion to the inner lip portion, said apparatus comprising:

an elongate cover structure disposed on at least two of said gutter supports and having a first longitudinal ridge feature formed adjacent the outer lip portion of a gutter and a second longitudinal ridge feature spaced from the first longitudinal ridge feature and formed adjacent the inner lip portion of the gutter so that a first gap is defined between the first longitudinal ridge feature and the outer lip portion and a second gap is defined between the second longitudinal ridge feature and the inner lip portion;

wherein the first longitudinal ridge feature has an apex portion disposed approximately at the elevation of the outer lip portion and the second longitudinal ridge feature has an apex portion that is lower than the elevation of the apex portion of the first ridge feature and wherein a relatively lower elevation portion of the elongate cover structure is disposed between the first and second longitudinal ridge features; and at least one upwardly extending end cap structure sealingly coupled to a first end of the elongate cover structure and having a top portion disposed at an elevation at least as great as the elevation of the first longitudinal ridge feature.

2. An apparatus according to claim 1, wherein the first gap is approximately one-eighth of an inch across.

3. An apparatus according to claim 1, wherein the second gap is approximately one-quarter of an inch across.

4. An apparatus according to claim 1, wherein the apex portion of the second longitudinal ridge feature is approximately half of the elevation of the apex portion of the first longitudinal ridge feature.

5. An apparatus according to claim 1, wherein the first and the second of said longitudinal ridge features are each disposed at approximately a twenty-two degree angle from the relatively lower elevation portion of the elongate cover structure.

6. An apparatus according to claim 5, wherein the relatively lower elevation portion of the elongate cover structure has a lateral dimension of approximately two and one-fourth inches.

7. An apparatus according to claim 1, wherein the elongate cover structure is formed of a sheet of one the following materials: a metal material, a resin-based material, a composite material, a metallic alloy material, a ceramic material, a wooden material, a glass material, a fiber-reinforced material, a plastic material, a molded material, an aluminum material, a polymer material, a paper-coated material, a material having a low friction surface, a waterproof material, a magnetic material, a magnetized material, an electrically conducting material, an impregnated fabric material, or a combination of any of the foregoing materials.

8. An apparatus according to claim 1, wherein said apex portions of the first and second longitudinal ridge features comprise gradually curved portions formed in the elongate cover structure.

9. The device of claim 1 further including:

a support structure for maintaining the elongate cover, when so selectively positioned, fixed relative to the gutter.

10. A method of fabricating and installing a cover structure for separating debris from rainwater or other fluid flowing into a gutter that forms a trough adjacent a roof wherein the gutter has an outer lip portion and an inner lip portion and a series of gutter supports disposed from the outer lip portion to the inner lip portion, comprising the steps of:

using an extruding mechanism to form two spaced apart longitudinal ridge features in an elongated sheet, wherein a first of said ridge features has a first apex and a second of said ridge features has a second apex disposed at a lower elevation than the first apex, to form a cover; and disposing the cover over a trough of a gutter to define first and second gaps, respectively, between the cover near the first ridge feature and the outer lip portion, and between the cover near the second ridge feature and the inner lip portion.

11. A method according to claim 10, wherein said length of substantially flat sheet material is a roll of such material.

12. A method according to claim 11, wherein said roll of material is a roll of aluminum material.

13. A method according to claim 10, wherein the first and the second of said ridge features are each disposed at approximately a twenty-two degree angle from the substantially flat sheet material.

14. A method according to claim 13, wherein the apex of each of said first and said second of said ridge features forms an angle of approximately ninety degrees in said substantially flat sheet material.

15. A method according to claim 14, wherein a central base portion of said first ridge feature and a base of said second ridge feature are spaced apart approximately two and one-fourth inches.

16. A method of handling fluid runoff from a roof of a building adjacent to a trough structure, comprising the steps of:

temporarily collecting a portion of the fluid runoff from a roof in a fluid collection region of an elongate cover structure disposed above a trough, wherein said fluid collection region is disposed between a pair of elongate ridges formed in said elongate cover structure;

draining a first portion of said fluid runoff over a first one of the pair of elongate ridges which is disposed at a first elevation and then into the trough; and draining a second portion of said fluid including non-fluid debris over a second one of the elongate ridges disposed at a second elevation higher than the first elevation, and then into the trough, with at least a portion of said non-fluid debris bypassing the trough.

17. A method according to claim 16, wherein said elongate cover structure is disposed over at least two trough hanger elements which connect the trough to a portion of the building.

18. A method according to claim 17, further comprising using at least one upwardly extending structure sealingly coupled to a first end of the elongate cover structure and having a top portion disposed at an elevation at least as great as the elevation of the first longitudinal ridge.

19. A device for guiding flow of a fluid into a gutter while tending to separate debris from the fluid, wherein the gutter includes an inner lip positionable substantially adjacent and beneath a roof, an outer lip spaced apart transversely from the inner lip and disposed outwardly of the roof, and a trough between the inner and outer lips adapted to collect run-off of a debris-carrying fluid from the roof, said device including:

a substantially fluid impermeable elongate cover including a first longitudinal ridge near a first side of the cover having a first apex, a second longitudinal ridge near a second and opposite side of the cover having a second apex, and an intermediate region between the first ridge and the second ridge;

wherein the elongate cover is selectively positionable above a trough of a gutter to define a first gap between the first side of the cover and an outer lip of the gutter, and a second gap between the second side of the cover and an inner lip of the gutter, with the first apex and the second apex at respective first and second elevations above the intermediate region, whereby the cover is adapted to receive a debris-carrying fluid from the roof and collect the fluid along the intermediate region, thereby increasing a fluid level along the intermediate region until said level is substantially equal to at least one of the first and second elevations, with continued receipt of the fluid causing a first portion of the fluid to flow at least over the ridge and apex associated with said at least one elevation, through the associated gap and into the trough.

20. The device of claim 19 wherein:

the first elevation is greater than the second elevation, whereby said first portion of the fluid flows transversely inward over the second ridge and through the second gap into the trough.

21. The device of claim 20 wherein:

said first ridge is disposed adjacent the first side of the cover, and the first elevation of the first apex is substantially the same as an elevation of the outer lip of the gutter when the cover is so selectively positioned, thereby to facilitate a flow of a second portion of the fluid transversely outward over the first ridge and into the trough through the first gap while at least a portion of the debris carried by the outward flow is propelled past the first gap and over the outer lip.

22. The device of claim 20 wherein:

the first apex is twice as high above the intermediate region as the second apex.

23. The device of claim 19 wherein:

the second gap is wider than the first gap.

24. The device of claim 23 wherein:

the second gap is about twice as wide as the first gap.

25. The device of claim 19 further including:

an end cap coupled to a first end of the elongate cover and extending at least to an elevation equal to at least one of said first and second elevations.

26. The device of claim 25 wherein:

said end cap is perforated to permit drainage of the fluid away from the intermediate region.

27. A covered gutter assembly including the device of claim 19 in combination with:

a gutter including an inner lip positionable substantially adjacent and beneath a roof, an outer lip spaced apart transversely from the inner lip and outwardly of the roof, and a trough disposed below the inner and outer lips and adapted to collect run-off of a debris-carrying fluid from the roof;

a gutter hanging structure for securing the gutter below the roof; and a mounting structure for maintaining the cover, when so selectively positioned, fixed with respect to the gutter.

* * * * *